US011810739B2

(12) United States Patent
Cheng et al.

(10) Patent No.: US 11,810,739 B2
(45) Date of Patent: Nov. 7, 2023

(54) ELECTRONIC DEVICE AND KNOB MODULE THEREOF

(71) Applicant: ASUSTEK COMPUTER INC., Taipei (TW)

(72) Inventors: Chao-Chieh Cheng, Taipei (TW); Yi-Ou Wang, Taipei (TW); Jia-Ruei Fang, Taipei (TW); Chienyi Huang, Taipei (TW); Chao-Shun Wang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/569,074

(22) Filed: Jan. 5, 2022

(65) Prior Publication Data

US 2022/0216020 A1 Jul. 7, 2022

(30) Foreign Application Priority Data

Jan. 7, 2021 (TW) ..... 110200154

(51) Int. Cl.
*H01H 19/02* (2006.01)
*H01H 25/04* (2006.01)
*H01H 9/18* (2006.01)

(52) U.S. Cl.
CPC ..... *H01H 25/04* (2013.01); *H01H 9/18* (2013.01); *H01H 19/02* (2013.01)

(58) Field of Classification Search
CPC ..... H01H 25/04; H01H 19/14; H01H 19/11; H01H 19/585; H01H 19/58; H01H 19/62; H01H 19/635; H01H 19/64; H01H 19/63; H01H 19/005; H01H 19/10; H01H 1/2041; H01H 19/56; H01H 19/03; H01H 19/02; H01H 2019/006; H01H 19/00; H01H 19/20; H01H 19/001; H01H 21/50; H01H 2221/01
See application file for complete search history.

(56) References Cited

U.S. PATENT DOCUMENTS

2006/0028822 A1* 2/2006 Tanamachi ..... G02B 27/024 362/276

FOREIGN PATENT DOCUMENTS

| | | | | |
|---|---|---|---|---|
| CN | 2624526 Y | | 7/2004 | |
| CN | 2874749 Y | | 2/2007 | |
| CN | 102194597 A | | 9/2011 | |
| CN | 106764683 | * | 5/2017 | ..... H01H 19/025 |
| CN | 206236597 U | | 6/2017 | |

* cited by examiner

*Primary Examiner* — Ahmed M Saeed
(74) *Attorney, Agent, or Firm* — Muncy, Geissler, Olds & Lowe, P.C.

(57) ABSTRACT

An electronic device and a knob module thereof are provided. The knob module includes a circuit board, a rotary encoder, a light guide structure, a plurality of light emitting units, and a rotation cover. The rotary encoder is disposed on the circuit board. The light guide structure is disposed on the circuit board. The light guide structure includes a light guide ring and an annular light guide wall. The light guide ring surrounds the rotary encoder. The annular light guide wall extends downward from the light guide ring to abut against the circuit board. The plurality of light emitting units is disposed on the circuit board and located between the annular light guide wall and the rotary encoder for emitting light toward the annular light guide wall. The rotation cover is disposed on the rotary encoder.

8 Claims, 6 Drawing Sheets

ELECTRONIC DEVICE AND KNOB MODULE THEREOF

CROSS-REFERENCE TO RELATED APPLICATION

This application claims the priority benefit of Taiwan application serial No. 110200154, filed on Jan. 7, 2021. The entirety of the above-mentioned patent application is hereby incorporated by reference herein and made a part of the specification.

BACKGROUND OF THE INVENTION

Field of the Invention

The disclosure relates to a knob module, and in particular, to an electronic device and a knob module thereof.

Description of the Related Art

With the development of technologies, users have increasingly high requirements for human interface device (HID). Compared with a key switch, a knob switch provides a user with more diverse operation manners and is especially advantageous in multi-option selection operations.

However, limited by a dial structure, a conventional knob switch cannot provide a light emitting function, resulting in inconvenient use in dim places.

BRIEF SUMMARY OF THE INVENTION

The disclosure provides a knob module for an electronic device. The knob module includes a circuit board, a rotary encoder, a light guide structure, a plurality of light emitting units, and a rotation cover. The rotary encoder is disposed on the circuit board. The light guide structure is disposed on the circuit board. The light guide structure includes a light guide ring and an annular light guide wall.

The light guide ring surrounds the rotary encoder. The annular light guide wall extends downward from the light guide ring to abut against the circuit board. The plurality of light emitting units is disposed on the circuit board and located between the annular light guide wall and the rotary encoder for emitting light toward the annular light guide wall. The rotation cover is disposed on the rotary encoder.

The disclosure further provides an electronic device. The electronic device includes a working area, a keyboard module, a touchpad, and a knob module. The keyboard module and the touchpad are disposed on the working area. The knob module is disposed on the working area and is located between the keyboard module and the touchpad. The knob module includes a circuit board, a rotary encoder, a light guide structure, a plurality of light emitting units, and a rotation cover.

The rotary encoder is disposed on the circuit board. The light guide structure is disposed on the circuit board. The light guide structure includes a light guide ring and an annular light guide wall. The light guide ring surrounds the rotary encoder. The annular light guide wall extends downward from the light guide ring to abut against the circuit board. The plurality of light emitting units is disposed on the circuit board and located between the annular light guide wall and the rotary encoder for emitting light toward the annular light guide wall. The rotation cover is disposed on the rotary encoder.

By the knob module of the disclosure, light emitting elements (that is, the light guide structure and the light emitting units) are integrated into a knob in a limited space. In one aspect, a light emitting function is provided, thereby avoid the inconvenient use of a knob in dim places. In another aspect, the advantage of a small size of the knob module is beneficial to the integration of the knob module into a portable electronic device.

DETAILED DESCRIPTION OF THE EMBODIMENTS

More detailed descriptions of the specific embodiments of the disclosure are provided below with reference to the accompanying drawings. The features and advantages of the disclosure are described more clearly according to the following description and claims. It is to be noted that all of the drawings are in very simplified forms and imprecise proportions, and is used only for assisting in conveniently and clearly explaining the objective of the embodiments of the disclosure.

The disclosure relates to a knob module. The knob module is configured to an electronic device. The electronic device is a desktop computer, a notebook computer, a screen, an external input device, a smartphone, a handheld game console, or the electronic products that alternatively controlled by a knob.

Figure 1:
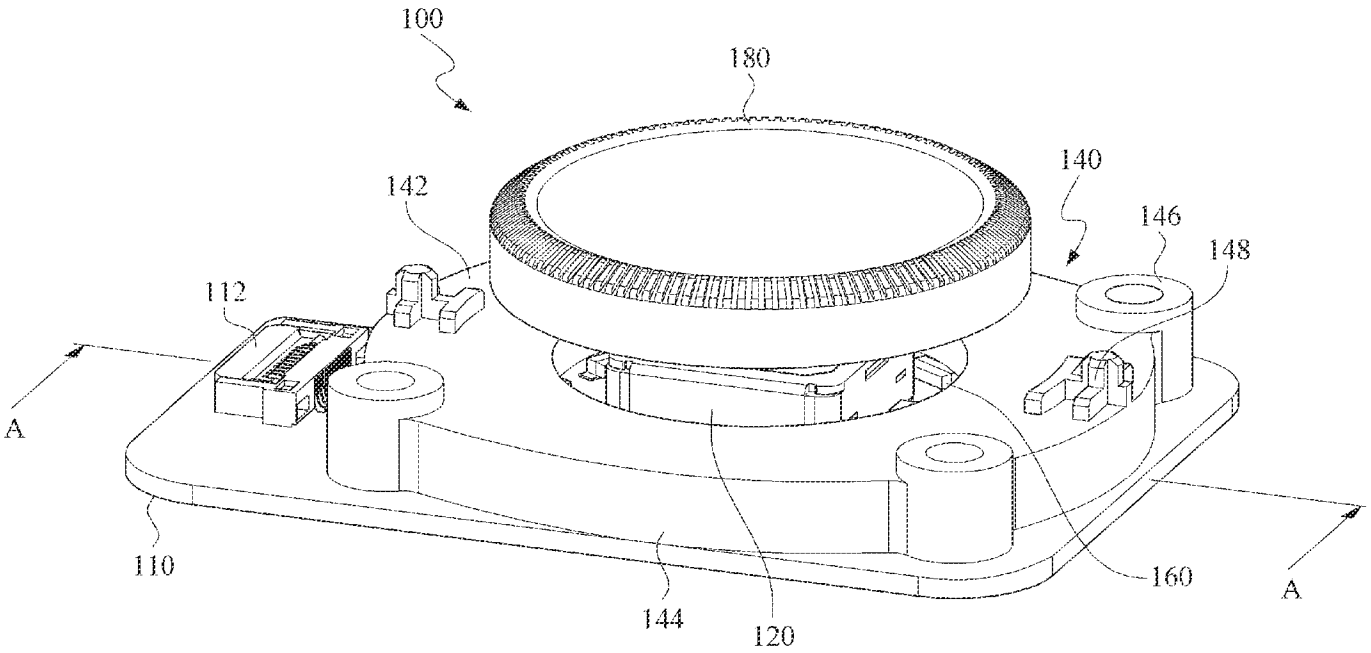
FIG. 1 is a three-dimensional schematic diagram of an embodiment of a knob module according to the disclosure.
Figure 2:
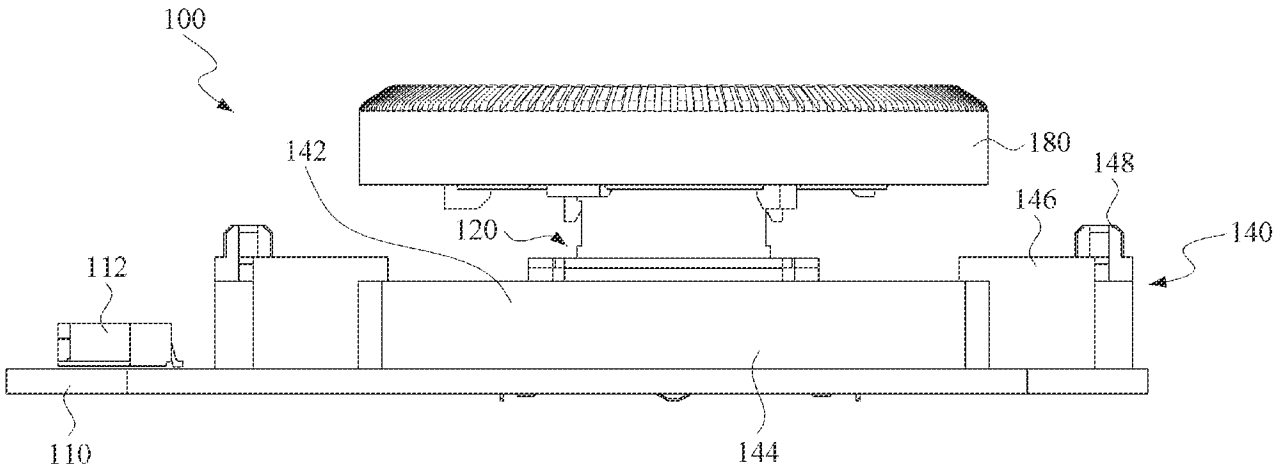
FIG. 2 is a schematic front view of the knob module in FIG. 1.
Figure 3:
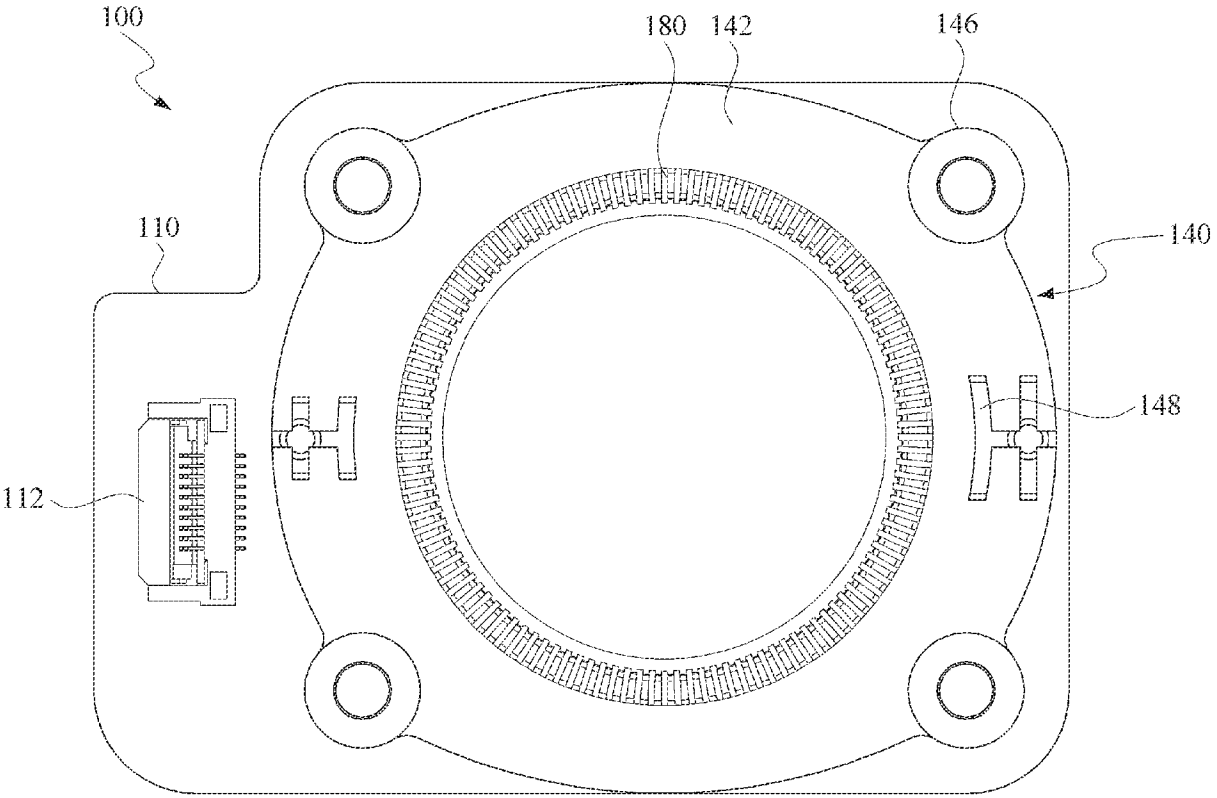
FIG. 3 is a schematic top view of the knob module in FIG. 1.
Figure 4:
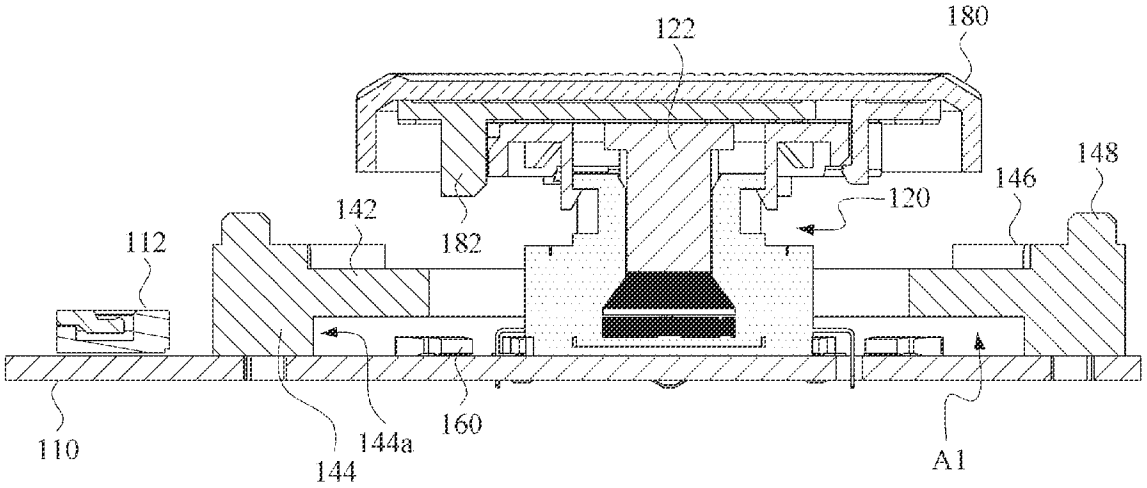
FIG. 4 is a schematic cross-sectional view of the knob module in FIG. 1 along A-A.
Figure 5:
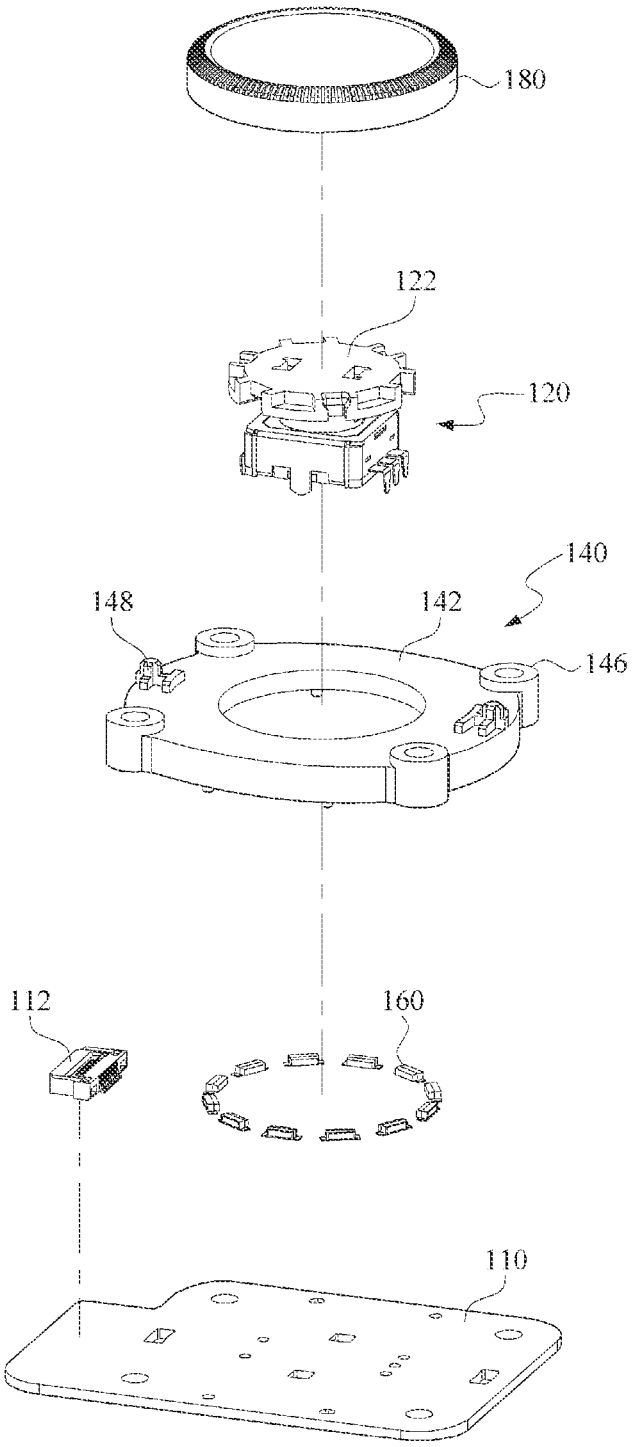
FIG. 5 is a schematic exploded view of the knob module in FIG. 1.

FIG. 1 is a three-dimensional schematic diagram of an embodiment of a knob module according to the disclosure. FIG. 2 is a schematic front view of the knob module in FIG. 1. FIG. 3 is a schematic top view of the knob module in FIG. 1. FIG. 4 is a schematic cross-sectional view of the knob module in FIG. 1 along A-A. FIG. 5 is a schematic exploded view of the knob module in FIG. 1.

As shown in the figures, the knob module 100 includes a circuit board 110, a rotary encoder 120, a light guide structure 140, a plurality of light emitting units 160, and a rotation cover 180.

The rotary encoder 120 is disposed on the circuit board 110. In an embodiment, the rotary encoder 120 is a rotary encoder 120 including a pressing switch. That is, the rotary encoder 120 not only detects a rotation signal applied to the rotary encoder 120, but also detects a pressing signal applied to the rotary encoder 120 and is able to function as a switch.

The light guide structure 140 is disposed on the circuit board 110. The light guide structure 140 includes a light guide ring 142 and an annular light guide wall 144. The light guide ring 142 surrounds the rotary encoder 120. The annular light guide wall 144 extends downward from the light guide ring 142 to abut against the circuit board 110. In an embodiment, an outer side surface of the annular light guide wall 144 is flush with an outer side surface of the light guide ring 142, and an annular space A1 is defined between the light guide ring 142 and the annular light guide wall 144, to accommodate the light emitting units 160.

In an embodiment, as shown in the figures, the light guide structure 140 further includes a plurality of fixing columns 146. These fixing columns 146 are located on an outer side of the light guide ring 142 and are connected to the light guide ring 142, for positioning the light guide ring 142 above the light emitting units 160.

In an embodiment, as shown in the figures, upper edges of these fixing columns 146 slightly protrude from an upper surface of the light guide ring 142. In an embodiment, these fixing columns 146 are fixed on the circuit board 110 through clamping, locking, or the like, so that the light guide structure 140 is fixed on the circuit board 110.

The plurality of light emitting units 160 is disposed on the circuit board 110 and is disposed around the rotary encoder 120. These light emitting units 160 are disposed between the annular light guide wall 144 and the rotary encoder 120, and emit light toward the annular light guide wall 144. In an embodiment, these light emitting units 160 are in the annular space A1 defined by the light guide ring 142 and the annular light guide wall 144.

In an embodiment, these light emitting units 160 are symmetrically distributed around the rotary encoder 120, or arranged around the rotary encoder 120 at fixed intervals, to ensure the uniformity of illumination generated by the light guide ring 142. In an embodiment, to improve the uniformity of light emitted upward from the light guide ring 142, a light diffusion agent is added to the light guide structure 140. In an embodiment, to improve the uniformity of light emitted upward from the light guide ring 142, a rough surface is formed on a surface 144*a* of the annular light guide wall 144 facing the light emitting units 160.

The rotation cover 180 is disposed on the rotary encoder 120 for a user to operate. In an embodiment, an inner side of the rotation cover 180 includes a support member 182. The support member 182 is sleeved on a control member 122 of the rotary encoder 120.

In an embodiment, as shown in the figures, the light guide ring 142 further includes at least one fixing member 148, to fix a housing (not shown) on the light guide structure 140. The housing is a casing of an electronic device.

In an embodiment, the rotary encoder 120 is a rotary encoder including a pressing switch. The control member 122 is not only for rotating to generate a rotation signal, but also for pressing to generate a pressing signal. In an embodiment, a minimum height (that is, a height when the rotary encoder 120 is pressed to the limit) of the rotary encoder 120 is greater than a height of the light guide structure 140, so as to prevent the rotation cover 180 from colliding with the light guide structure 140 and ensure a pressing stroke of the rotary encoder 120.

In an embodiment, a diameter of the rotation cover 180 is greater than an inner diameter of the light guide ring 142 and less than an outer diameter of the light guide ring 142, so as to ensure that uniform annular light generated by the light emitting units 160 through the light guide ring 142 is projected outward from an outer edge of the rotation cover 180 to provide illumination. In an embodiment, the rotation cover 180 is made of a transparent material to improve the overall luminous brightness.

In an embodiment, the circuit board 110 includes a connector 112 to facilitate the installation and integration of an electronic system. The connector 112 is electrically connected to the rotary encoder 120 for transmitting a signal generated by the rotary encoder 120 to outside. However, the disclosure is not limited thereto. In an embodiment, the knob module 100 is alternatively integrated on a circuit board of another input device such as a circuit board of a keyboard module.

Figure 6:
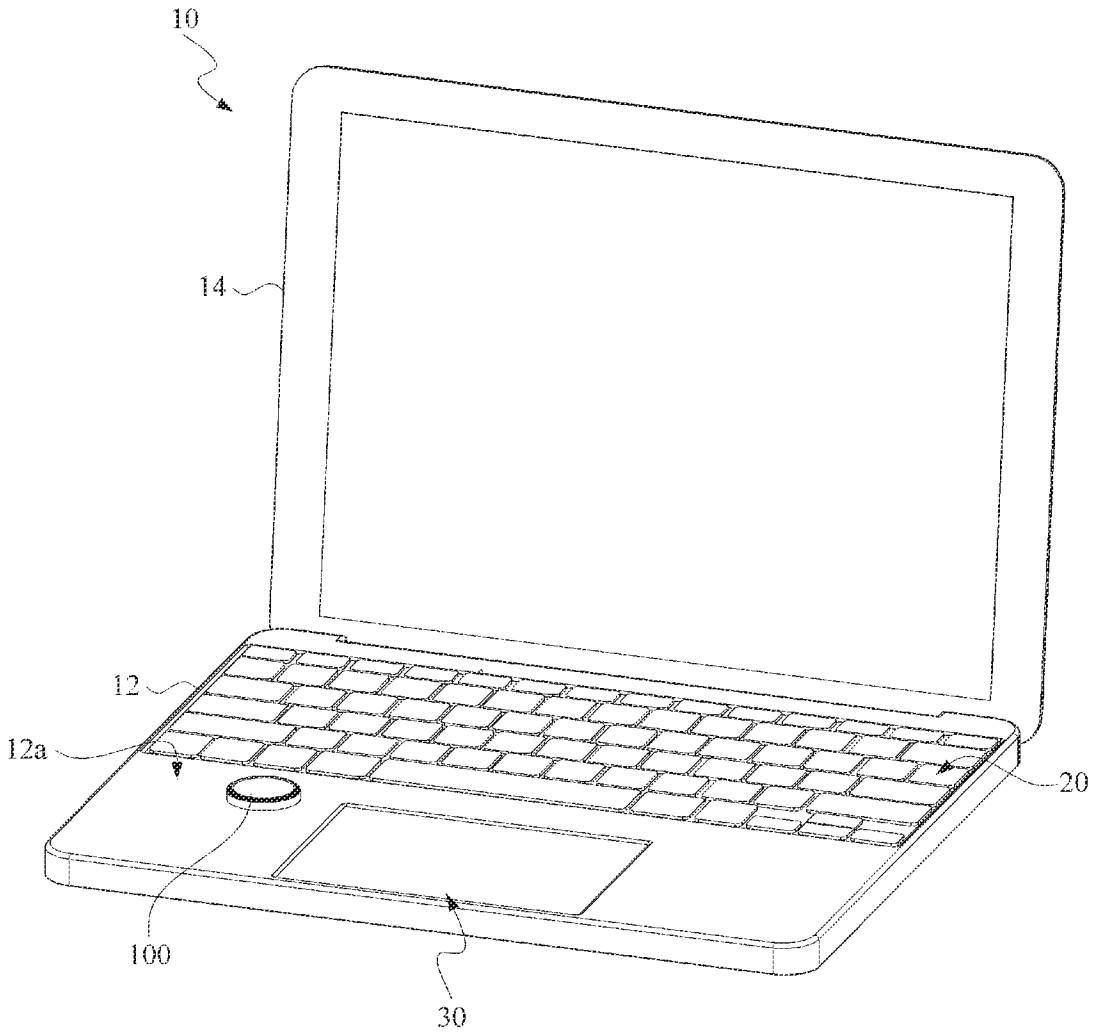
FIG. 6 shows an embodiment of an arrangement position of a knob module of the disclosure on an electronic device.

FIG. 6 shows an embodiment of an arrangement position of a knob module of the disclosure on an electronic device. In the figure, the disclosure is described by using a notebook computer as an example.

As shown in the figure, an electronic device 10 includes a main unit 12 and a screen 14. The main unit 12 includes a working area 12*a*. The working area 12*a* is a main operation region for the user to operate the electronic device 10.

To meet use requirements, a keyboard module 20, a touchpad 30, and the knob module 100 of the disclosure are disposed on the working area 12*a* of the electronic device 10. The keyboard module 20 is a mechanical keyboard, an electronic keyboard, or a virtual keyboard. The touchpad 30 is a capacitive touchpad, a resistive touchpad, or an optical touchpad.

In an embodiment, as shown in the figure, the knob module 100 is located between the keyboard module 20 and the touchpad 30, which is convenient for the user to operate. In another embodiment, the knob module 100 is located on a left side of the touchpad 30.

By the knob module 100 of the disclosure, the light guide structure and the light emitting units are integrated into a knob in a limited space. In one aspect, a light emitting function is provided, thereby avoids the inconvenient use of a knob in dim places. In another aspect, the advantage of a small size of the knob module is beneficial to the integration of the knob module into a portable electronic device.

The above is merely exemplary embodiments of the disclosure, and does not constitute any limitation on the disclosure. Any form of equivalent replacements or modifications to the technical means and technical content provided in the disclosure made by a person skilled in the art without departing from the scope of the technical means of the disclosure still fall within the content of the technical means of the disclosure and the protection scope of the disclosure.

What is claimed is:

1. A knob module, comprising:

a circuit board;

a rotary encoder, disposed on the circuit board;

a light guide structure, disposed on the circuit board, wherein the light guide structure comprises a light guide ring and an annular light guide wall, the light guide ring surrounds the rotary encoder, and the annular light guide wall extends downward from the light guide ring to abut against the circuit board;

a plurality of light emitting units, disposed on the circuit board and located between the annular light guide wall and the rotary encoder for emitting light toward the annular light guide wall; and a rotation cover, disposed on the rotary encoder, wherein an outer side surface of the annular light guide wall is flush with an outer side surface of the light guide ring, the light guide structure further comprises a plurality of fixing columns, the fixing columns are located on an outer side of the light guide ring and are connected to the light guide ring, for positioning the light guide ring above the light emitting units, and upper edges of the fixing columns protrude upward from an upper surface the light guide ring.

2. The knob module according to claim 1, wherein the light emitting units are located in an annular space defined by the light guide ring and the annular light guide wall.

3. The knob module according to claim 1, wherein a minimum height of the rotary encoder is greater than a height of the light guide structure.

4. The knob module according to claim 1, wherein the light emitting units are symmetrically distributed around the rotary encoder.

5. The knob module according to claim 1, wherein a diameter of the rotation cover is greater than an inner diameter of the light guide ring.

6. The knob module according to claim 1, wherein the circuit board comprises a connector.

7. The knob module according to claim 1, wherein the rotation cover is made of a transparent material.

8. An electronic device, comprising:

a working area;

a keyboard module, disposed on the working area;

a touchpad, disposed on the working area; and a knob module, disposed on the working area and located between the keyboard module and the touchpad, wherein the knob module comprises:

a circuit board;

a rotary encoder, disposed on the circuit board;

a light guide structure, disposed on the circuit board, wherein the light guide structure comprises a light guide ring and an annular light guide wall, the light guide ring surrounds the rotary encoder, and the annular light guide wall extends downward from the light guide ring to abut against the circuit board;

a plurality of light emitting units, disposed on the circuit board and located between the annular light guide wall and the rotary encoder for emitting light toward the annular light guide wall; and a rotation cover, disposed on the rotary encoder, wherein an outer side surface of the annular light guide wall is flush with an outer side surface of the light guide ring, wherein the light guide structure further comprises a plurality of fixing columns, the fixing columns are located on an outer side of the light guide ring and are connected to the light guide ring, for positioning the light guide ring above the light emitting units, and wherein upper edges of the fixing columns protrude upward from an upper surface the light guide ring.

* * * * *